US006146212A

United States Patent [19]

Kipnik

[11] Patent Number: 6,146,212

[45] Date of Patent: Nov. 14, 2000

[54] TERMINAL CONNECTOR ASSEMBLY

[75] Inventor: Norbert Kipnik, Wutach-Ewattingen, Germany

[73] Assignee: Ria Electronic Albert Metz, Germany

[21] Appl. No.: 09/318,918

[22] Filed: May 26, 1999

[30] Foreign Application Priority Data

May 29, 1998 [DE] Germany ..... 298 09 757 U

[51] Int. Cl.[7] ..... H01R 9/22

[52] U.S. Cl. ..... 439/709; 439/811

[58] Field of Search ..... 439/709, 710, 439/711, 723

[56] References Cited

U.S. PATENT DOCUMENTS 5,722,850 3/1998 White ..... 439/404

*Primary Examiner*—Neil Abrams
*Assistant Examiner*—Eugene G. Byrd
*Attorney, Agent, or Firm*—Eugene E. Renz, Jr.

[57] ABSTRACT

A terminal connector assembly comprising a terminal housing, having at least one terminal contact which can be inserted into the terminal housing for connection to a conductor, and with a plug contact for the plug-in connection of a contact pin assigned to each terminal contact and in electrical contact therewith, means for pre-inserting and holding the said contact pin as a separate contact pin in the plug contact, whereby at least one end of the contact pin projects out of the terminal housing.

9 Claims, 1 Drawing Sheet

TERMINAL CONNECTOR ASSEMBLY

BACKGROUND OF THE INVENTION

Terminal connectors of this general type, as described in, for example, EP-B1 536,523, are used for the plug-in connection of conductors to electronic circuits, especially to printed-circuit boards. The conductor is connected to the terminal connector by means of a terminal contact. These terminal contacts can be, for example, of the screw type or of the insulation displacement type. Each terminal contact is assigned its own plug contact, which is connected electrically to the terminal contact. By means of these plug contacts, the terminal connector can be mounted detachably on contact pins, which are connected to the electric network. For example, the terminal connector can be mounted on pins which have been inserted into a printed-circuit board and soldered to it.

In order to connect the known terminal connector by plugging into an electronic circuit, this circuit must be provided with the appropriate contact pins. To provide a printed-circuit board with such contact pins, these contact pins can, for example, be mounted in a separate plastic block by simply pressing them in or by casting them in place. The block with the contact pins is then mounted on the printed-circuit board, and the contact pins are soldered to the conductive strips on the printed-circuit board. The terminal connector is then mounted by its plug contacts on the contact pins, which have already been connected to the printed-circuit board in a mechanically strong and electrically conductive manner. A separate fabrication process is required for the block with the contact pins, and the extra material also drives up the cost. Mounting the block with the contact pins on the printed circuit board also means an additional assembly step during fabrication.

SUMMARY OF THE INVENTION

With the foregoing in mind, the invention is based on the task of improving a terminal connector of the general type described above in such way that production and assembly become simpler and less expensive.

To this end, the terminal housing is provided with at least one terminal contact which can be inserted into the terminal housing for connection to a conductor and a plug contact for the plug-in connection of a contact pin assigned to each terminal contact. In accordance with the present invention, the contact pin can be presented held as a separate contact pin in the plug contact wherein at least one end of the pin projects out of the terminal housing.

One of the features of the invention is that the contact pins are not attached in a separate step to the electronic circuit but rather inserted into the circuit by means of the terminal connector itself, into which the contact pins have been pre-inserted. The terminal connector thus takes over the function of the block, which, according to the state of the art, is needed to insert the contact pins into the circuit. The cost of material and the cost of producing the plastic block with the inserted contact pins can thus be eliminated. The plug contact preferably has springy blade contacts, so that the contact pin is clamped and held elastically in the plug contact. The blade contacts and the parts of the terminal contact which come in contact with the conductor can be punched out of sheet metal as a single part. If the terminal contact is a screw-type terminal contact with a protective element for the conductor, then preferably the blade contacts of the plug contact and the conductor protection element of the terminal contact are punched out of sheet metal as a single part.

It is also advantageous for the plug contact to be located behind the terminal contact, relative to the insertion direction of the conductor, and for the axis of its insertion direction to be at an angle to the direction in which the conductor is inserted into the terminal contact. As a result, the terminal contact and plug contact can be designed to form a very compact unit, so that the overall dimensions of the terminal connector can be very small. In addition, the conductor can be introduced and connected at an acute angle, preferably parallel to the printed-circuit board. The axis of the insertion direction of the plug contact is preferably perpendicular to the axis of the insertion direction of the conductor into the terminal contact. The plug contact can thus be designed to pass all the way through the terminal housing, so that contact pins can be inserted from two directions. This makes the terminal connector more versatile in its applications.

In an advantageous embodiment, the contact pins have a lateral bulge, which preferably is produced by a stamping operation. The lateral bulge defines a plugging-in stop for plugging of the contact pin into the plug contact, so that the contact pin can be positioned easily in the plug contact and so that the pin necessarily assumes the precise axial position required. This simplifies automatic assembly.

A sealing lip is formed preferably on the terminal housing, at least on one of the entry sides of the plug contact. This lip rests elastically against the inserted contact pin. The sealing lip produces a clamping action and thus works together with the plug contact to hold the contact pin in the terminal connector. In addition, the sealing lip also has the effect of sealing out soldering fumes, which are formed when the terminal connector, with the pre-inserted contact pins, is mounted on a printed-circuit board and the contact pins are soldered to the conductive strips of the printed-circuit board.

BRIEF DESCRIPTION OF THE DRAWINGS

These and other objects of the present invention and various features and details of the operation and construction thereof are hereinafter more fully set forth with reference to the accompanying drawings, wherein.

DESCRIPTION OF THE METHOD AND SYSTEM

Figure 1:
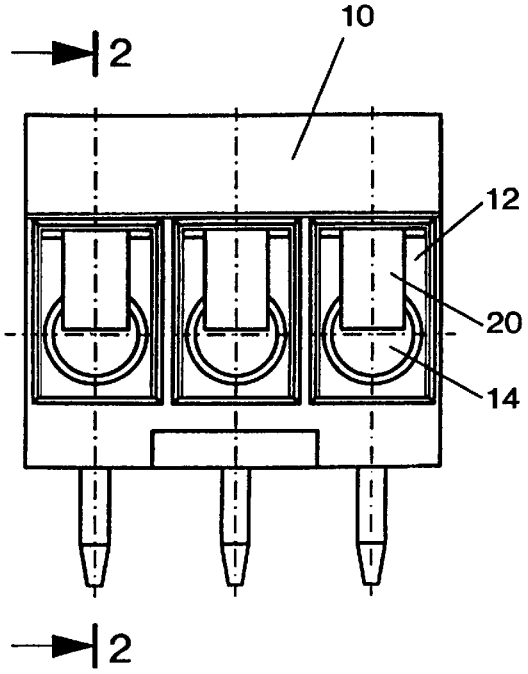
FIG. 1 shows a front view of the side with the terminal contacts.

Referring now to the drawings and particularly to FIG. 1, the terminal connector is designed as a three-terminal connector. The terminal connector comprises a terminal housing 10 preferably made of plastic, having three openings 11 arranged next to each other in one of the sides of the housing. Terminal body 12 preferably made of a pressure die-cast metal is inserted into each of the openings. Each terminal body 12 has a conductor input opening 14, which is designed as a hole extending inward from the front side. Perpendicular to the axis of conductor input opening 14, a threaded hole leads in each case from above through terminal body 12 into conductor input opening 14. A cylindrical terminal screw 16, which is held captive in terminal housing 10, can be screwed into the threaded hole.

Plug-in openings 18 extending in each case perpendicular to the axis of conductor input openings 14 are provided in terminal housing 10, behind the openings for terminal bodies 12. These plug-in openings 18 pass all the way through terminal housing 10 behind the face of inserted terminal bodies 12, i.e., the surface facing away from conductor input opening 14.

Each terminal body 12 has its own conductor protection element 20. Conductor protection element 20 is bent into the shape of U, and its free sidepiece 20*a* extends from the front end into conductor input opening 14. The sidepiece 20*b* of conductor protection element 20 above terminal body 12 has a circular opening for terminal screw 16. Blade contacts 21 of conductor protection element 20 which are bent over at a right angle toward the upper sidepiece 20*b* and which form the elastic contacts of a plug contact 22, are connected to this upper sidepiece 20*b* of conductor protection element 20. Conductor protection element 20 and the blade contacts of plug contact 22 are punched out of sheet meal as a single part. The insertion direction of plug contact 22 is perpendicular to the insertion direction of conductor input opening 14 of terminal body 12. Plug contact 22 is completely inside the contour of terminal body 12, so that, during assembly of the terminal connector, terminal body 12, in which conductor protection element 20 and plug contact 22 have already been installed, can be pushed into the opening in terminal housing 10 from the side.

After terminal screw 16 has been inserted, terminal body 12 is held captive together with conductor protection element 20 and plug contact 22 in terminal housing 10.

The diameter of plug-in opening 18 is narrowed in each case above and below plug contact 22, by a sealing lip 24. Sealing lips 24 are formed integrally as circular rings on terminal housing 10 and are elastically deformable along the radially inward-pointing edge because of the thinness of the material.

A contact pin 26 is pre-inserted into each plug contact 22. The diameters of contact pin 26 and of plug contact 22 are coordinated with each other in such a way that contact pin 26 is clamped in plug contact 22 so that good electrical contact is guaranteed between plug contact 22 and contact pin 26. In addition, the diameter of contact pin 26 and the inside diameter of the sealing lips 24 are coordinated with each other in such a way that sealing lips 24 are elastically deformed when contact pin 26 is inserted and thus rest against the circumference of contact pin 26 in such a way as to form a seal.

Contact pins 26 have a lateral bulge 28, which is preferably produced by squeezing contact pin 26 in the area of bulge 28, so that its diameter is increased in one diametrical direction and decreased in the diametrical direction perpendicular to the first. Bulge 28 is located at a point on the axis of contact pin 26 such that the section of contact pin 26 on one side of bulge 28 is somewhat longer than the axial distance between sealing lips 24. Contact pins 26 can thus be inserted automatically into the terminal connector until bulge 28 comes up against sealing lip 24. Contact pin 24 then passes through plug contact 22 and makes contact with it, whereas contact pin 26 is sealed off on both sides of plug contact 22 by sealing lips 24.

The end of contact pin 26 situated on the side of bulge 28 facing away from plug contact 22 is designed as a soldering or plug-in connection. After contact pin 26 has been pre-inserted, a suitable length of the pin thus projects out of the terminal housing 10.

Figure 2:
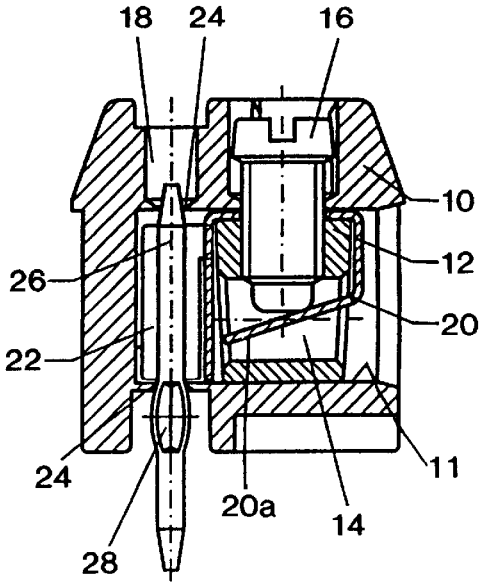
FIG. 2 is a sectional view of the terminal connector through intersection line A-B.
Figure 3:
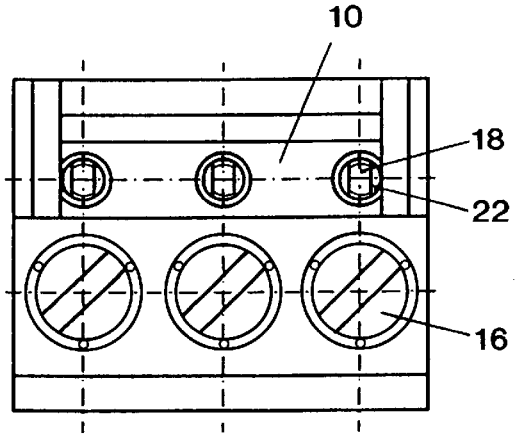
FIG. 3 shows a plan view of the terminal connector.

In the example shown in FIGS. 1 and 2, contact pins 26 are pre-inserted from the bottom into the terminal connector. The terminal connector with pre-inserted contact pins 26 can be mounted on a printed-circuit board, and the ends of contact pins 26 projecting out of terminal housing 10 will be inserted into holes in the printed-circuit board and brought into contact with the appropriate conductive strips. Contact pins 26 can then be soldered to the conductive strips in a solder bath. Sealing lip 24 resting to form a seal against contact pin 26 prevents soldering fumes from entering the terminal connector. This is especially important when plug contact 22, conductor protection element 20, and contact pin 26 coming in contact with plug contact 22 are gold-plated.

Figure 4:
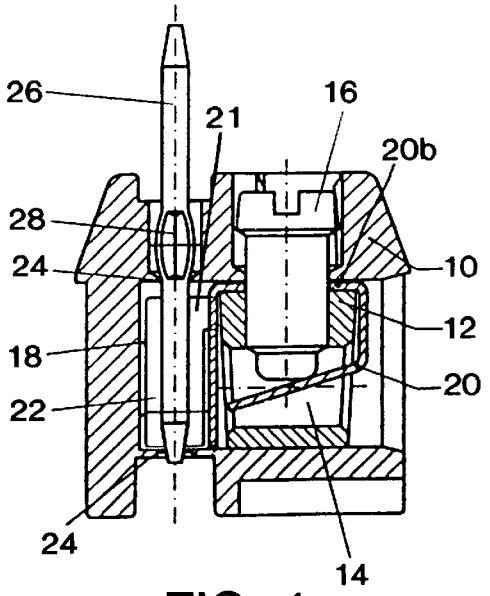
FIG. 4 is a sectional view corresponding to FIG. 2 with a contact pin inserted from above.

FIG. 4 shows an example in which contact pins 26 are inserted into the terminal connector from above. In this design, additional elements or circuits can be mounted from above on contact pins 26 and connected to the terminal connector.

It is obvious that, within a terminal connector, individual contact pins 26 can also be inserted from below, as shown in FIG. 2, while other contact pins 26 are inserted from above, as shown in FIG. 4. As a result, the terminal connector can also be used as an interconnection element in a sandwich assembly.

It is also easy to see that contact pins 26 can also be long enough to project out of terminal housing 10 both at the bottom and at the top. This is advantageous when the terminal connectors simultaneously form an interconnecting bridge between two circuits, e.g., in the case of a sandwich assembly of printed-circuit boards.

Even though particular embodiments of the present invention have been illustrated and described herein, it is not intended to limit the invention and changes and modifications may be made therein within the scope of the following claims for example.

What is claimed is:

1. A terminal connector system, comprising:

a housing;

a terminal contact assembly removably inserted and retained into said housing with electrically connected contracts, comprising;

a first contact portion for receiving, securing, and establishing electrical contact with an insulation displacement conductor;

a second contact portion integral with said first portion for receiving, securing, and maintaining electrical contact with a plug-in-contact pin; and a plug-in-contact pin for insertion into said second contact portion and a tail depending from said plug-in-contact pin and extending either above or below said housing, said plug-in-contact pin tail capable of being inserted and secured to a circuit board.

2. Terminal connector assembly according to claim 1, wherein the plug contact (22) is located behind the terminal contact (12) relative to the direction in which the conductor is inserted, and wherein the plug-in direction of the plug contact (22) is disposed at an angle to the direction in which the conductor is inserted into the terminal contact (12).

3. Terminal connector assembly according to claim 2, wherein the plug-in direction of the plug contact (22) is perpendicular to the direction in which the conductor is inserted into the terminal contact (12).

4. Terminal connector assembly according to claim 1, wherein the plug contact (22) is formed by elastic blade contacts.

5. Terminal connector assembly according to claim 4, wherein the terminal contact is a screw-type terminal contact with a terminal body (12) and including a conductor protection element (20), which extends into the conductor input opening (14) of the terminal body (12), and wherein the blade contacts of the plug contact (22) and the conductor protection element (20) are punched out of sheet metal as a single part.

6. Terminal connector assembly according to claim 3, wherein the plug contact (22) is completely inside the peripheral contour of the terminal body (12), being located behind the terminal body (12), relative to the direction in which the conductor is inserted.

7. Terminal connector assembly according to claim 1, wherein the plug contact (22) is installed in a plug-in opening (18) which passes all the way through the terminal housing (10), so that the contact pin (26) can project out of the terminal housing (10) in two opposite directions.

8. Terminal connector assembly according to claim 1, characterized in that a sealing lip (24) formed on the terminal housing (10) on at least one of the entry sides of the plug contact (22), said lip resting against the outside circumference of the pre-inserted contact pin (26) to form a seal.

9. Terminal connector assembly according to claim 1, wherein the contact pin (26) has a lateral bulge (28), which serves as an axial stop to ensure that the contact pin (26) assumes the proper position when it is inserted into the plug contact (22).

* * * * *